US012577743B2

(12) United States Patent
Kashima

(10) Patent No.: US 12,577,743 B2
(45) Date of Patent: Mar. 17, 2026

(54) WORK MACHINE

(71) Applicant: HONDA MOTOR CO., LTD., Tokyo (JP)

(72) Inventor: Soji Kashima, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 625 days.

(21) Appl. No.: 17/894,527

(22) Filed: Aug. 24, 2022

(65) Prior Publication Data

US 2024/0068181 A1 Feb. 29, 2024

(51) Int. Cl.
*E01C 19/42* (2006.01)
*E01C 23/088* (2006.01)

(52) U.S. Cl.
CPC ..... *E01C 23/0885* (2013.01)

(58) Field of Classification Search
CPC .. E01C 23/0885; E01C 23/088; E04F 21/248; E04F 21/245
See application file for complete search history.

(56) References Cited

U.S. PATENT DOCUMENTS 5,803,657 A * 9/1998 Hodgson ..... E04F 21/248 404/112
10,100,537 B1 * 10/2018 Guinn ..... E04F 21/247
2011/0104996 A1 * 5/2011 Peake ..... E04F 21/248 451/64
2018/0369981 A1 * 12/2018 Craft ..... B24B 47/12
2021/0180340 A1 * 6/2021 Potter ..... H02P 29/68
2022/0268035 A1 * 8/2022 Richards ..... E04F 21/248
2023/0250651 A1 * 8/2023 Esh ..... E04F 21/248 404/112

FOREIGN PATENT DOCUMENTS

CN 2249147 * 3/1997
JP 3039124 U 7/1997
WO WO-2007080003 A1 * 7/2007 ..... B23Q 11/0046

* cited by examiner

*Primary Examiner* — Carib A Oquendo
(74) *Attorney, Agent, or Firm* — THOMAS | HORSTEMEYER, LLP

(57) ABSTRACT

A work machine that smooths a road surface by rotating a blade contacting the road surface, the work machine comprises: a motor that rotates the blade; and a fan that cools the motor and is provided between the motor and the blade.

6 Claims, 7 Drawing Sheets

WORK MACHINE

BACKGROUND OF THE INVENTION

Field of the Invention

The present invention relates to a work machine that smooths a road surface by rotating blades contacting the road surface.

Description of the Related Art

Japanese Utility Model Registration No. 3039124 discloses a rechargeable rotary iron for leveling a concrete surface.

In recent years, in work machines for finishing a concrete surface, electrification has been promoted in order to reduce $CO_2$ emission. In a case where a high-output battery having a large capacity is mounted on a work machine, work can be performed for a long time, but a work machine having excellent cooling performance is desired from the viewpoint of stabilization of battery output, prolongation of battery life, and the like.

In view of the above problems, the present invention provides a work machine having excellent cooling performance.

SUMMARY OF THE INVENTION

According to one aspect of the present invention, there is provided a work machine that smooths a road surface by rotating a blade contacting the road surface, the work machine comprising: a motor that rotates the blade; and a fan that cools the motor and is provided between the motor and the blade.

According to the present invention, it is possible to provide a work machine having excellent cooling performance. Consequently, it is possible to stabilize the battery output and to prolong the life of the battery.

BRIEF DESCRIPTION OF THE DRAWINGS

The accompanying drawings, which are incorporated in and constitute a part of the specification, illustrate embodiments of the invention and, together with the description, serve to explain principles of the invention.

DESCRIPTION OF THE EMBODIMENTS

Figure 1:
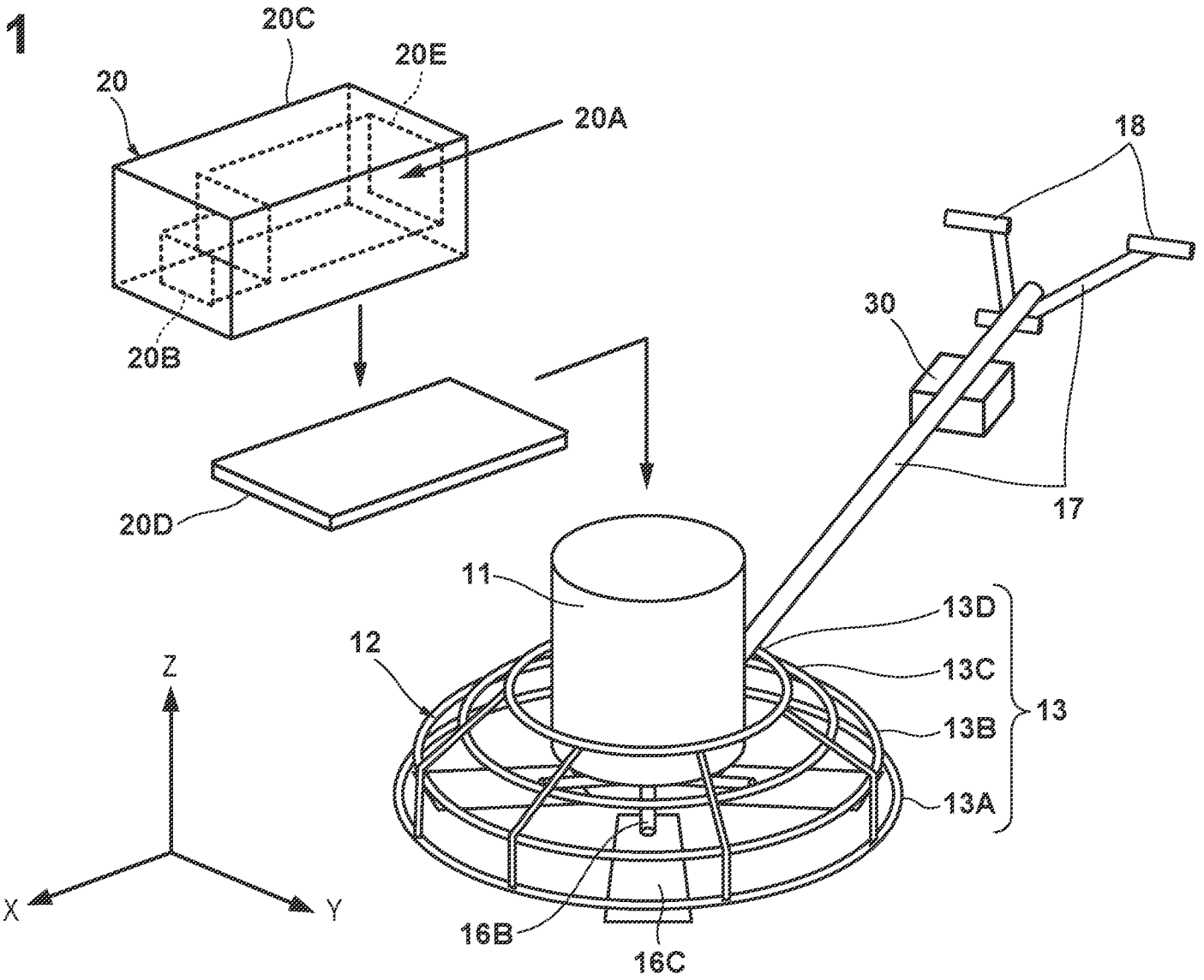
FIG. 1 is a perspective view illustrating a schematic configuration example of a finishing work machine according to an embodiment.

Hereinafter, embodiments will be described in detail with reference to the attached drawings. Note that the following embodiments are not intended to limit the scope of the claimed invention, and limitation is not made an invention that requires all combinations of features described in the embodiments. Two or more of the multiple features described in the embodiments may be combined as appropriate. Furthermore, the same reference numerals are given to the same or similar configurations, and redundant description thereof is omitted.

A finishing work machine 10 of an embodiment will be described. In the respective drawings described below, arrows X, Y, and Z indicate directions orthogonal to each other, an X direction indicates the front-and-rear direction of the finishing work machine 10, a Y direction indicates the left-and-right direction (width direction) of the finishing work machine 10, and a Z direction indicates the up-and-down direction of the finishing work machine 10. In the embodiment, the finishing work machine 10 will also be simply referred to as a work machine 10.

[Configuration Example of Finishing Work Machine]

Figure 2A:
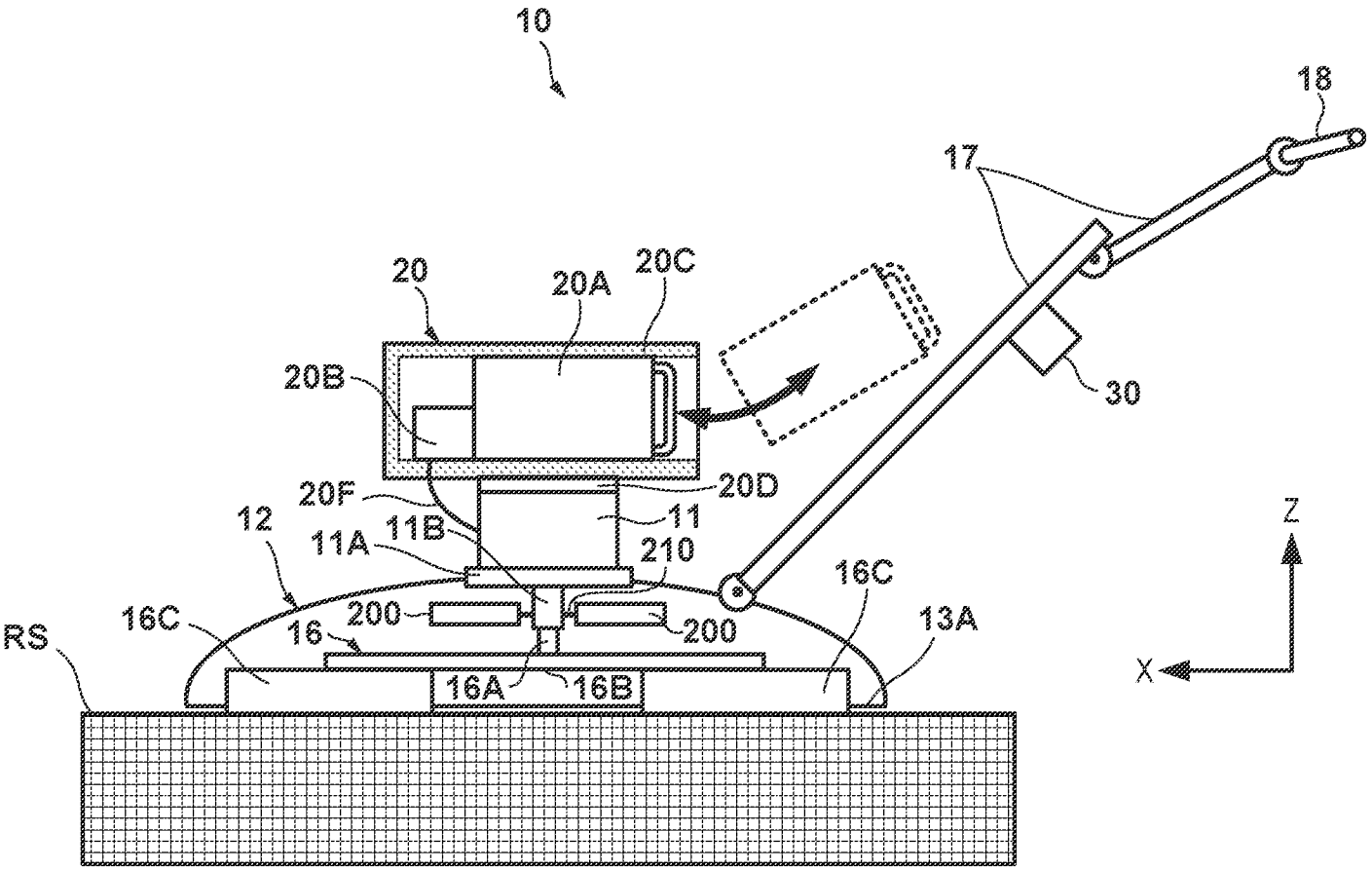
FIG. 2A is a side view schematically illustrating a configuration example of a finishing work machine in an XZ plane.
Figure 3:
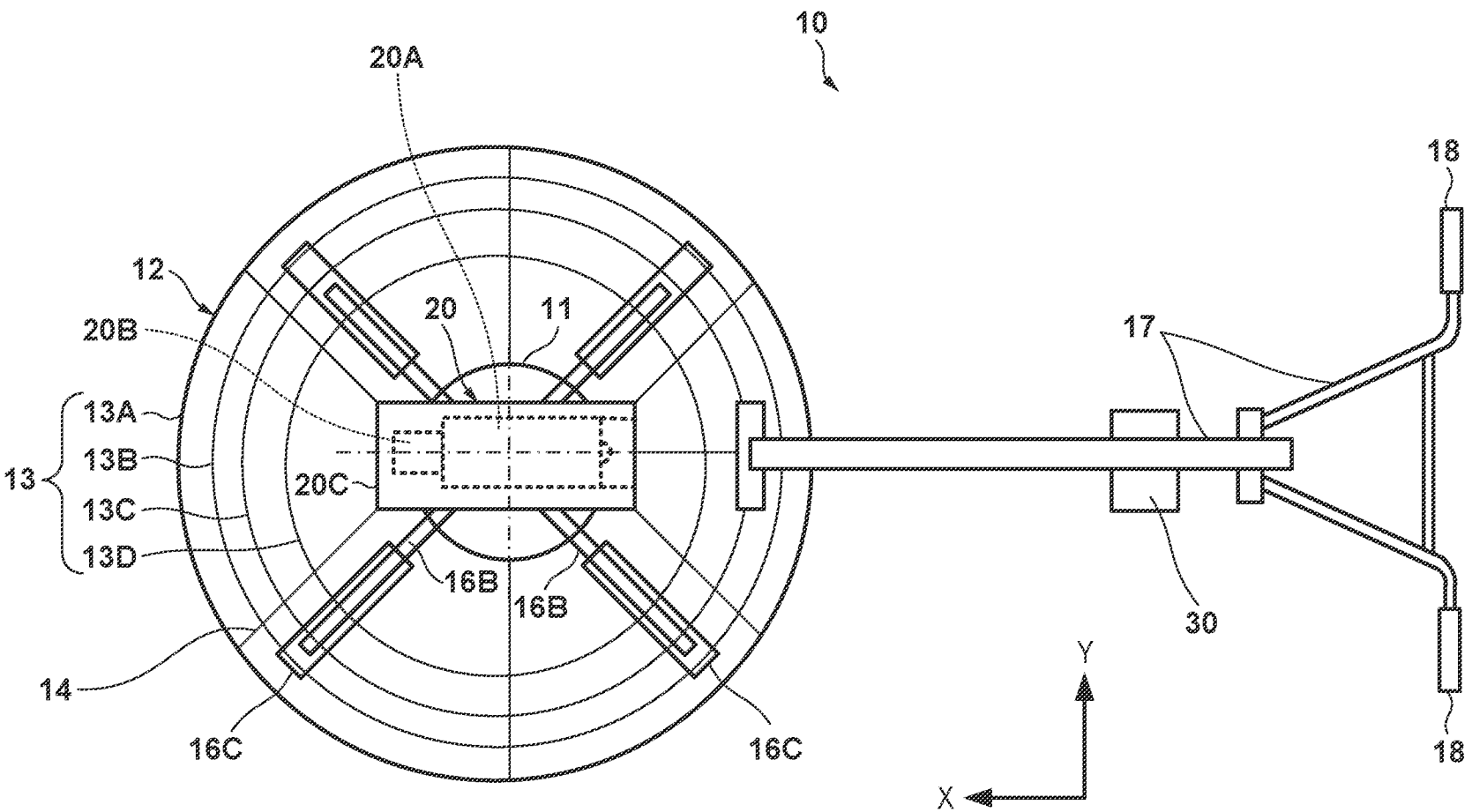
FIG. 3 is a top view schematically illustrating a configuration example of the finishing work machine on an XY plane.

FIG. 1 is a perspective view illustrating a schematic configuration example of the finishing work machine 10 according to an embodiment. FIG. 2A is a side view schematically illustrating a configuration example of the finishing work machine 10 in the XZ plane, and FIG. 3 is a top view schematically illustrating a configuration example of the finishing work machine 10 in the XY plane.

The finishing work machine 10 of the present embodiment is a finishing work machine that smooths a road surface RS by rotating blades 16C contacting the road surface RS. For example, at a construction site or the like, the finishing work machine 10 presses (contacts) the blades 16C (iron) on the road surface RS of concrete in an uncured state after the concrete is poured while rotating the blades 16C, and thus smooths the road surface RS. Work of smoothing the road surface RS of the concrete is referred to as finishing work, and the finishing work machine 10 of the present embodiment may be referred to as, for example, a trowel.

The finishing work machine 10 (trowel) includes a motor 11, a frame 12 (13, 14), a blade unit 16 (16A, 16B, 16C), an operation member 17, a power supply device 20, and a controller 30 (control device).

The operation member 17 is a shaft-shaped member extending obliquely upward in the Z direction from the frame 12. A handle 18 is formed at a distal end portion of the operation member 17 to be gripped by a worker. When the worker grips the handle 18 and moves the handle 18 in the front-and-rear direction, a force corresponding to movement (handle operation) of the handle 18 by the worker is transmitted to the frame 12 via the operation member 17. The worker performs a handle operation to move the road surface RS of the concrete while swinging the frame 12 of the finishing work machine 10 in the XY plane.

The finishing work machine 10 of the present embodiment includes a motor 11 that rotates the blades 16C, and a power supply device 20 having the battery pack 20A that supplies electric power to the motor 11. Here, the power supply device 20 is disposed above the motor 11.

As illustrated in FIG. 2A, the motor 11 is held by a motor holding member 11A provided on an upper portion of the frame 12, and the power supply device 20 is disposed above the motor 11. The motor holding member 11A is not illustrated in FIG. 1 for better understanding of the configuration of the finishing work machine 10. An upper end side of the motor holding member 11A is connected to an outer periphery of the motor 11, and a lower end side of the motor holding member 11A is connected to the frame 12. The motor 11 is held by the frame 12 via the motor holding member 11A. The motor 11 is held by the frame 12 with a rotation shaft 11B facing downward in the Z direction (vertically downward).

The rotation shaft 11B of the motor 11 is rotated by the power supplied from the power supply device 20. A shaft 16A (rotation shaft) of the blade unit 16 is connected to the rotation shaft 11B of the motor 11, and a blade support arm 16B and the blades 16C are rotated according to rotation of the shaft 16A. The frame 12 of the finishing work machine 10 is swung in the XY plane by the worker's handle operation, and the unevenness of the road surface RS in the Z direction is leveled due to the rotation of the blades 16C contacting the road surface RS.

As illustrated in FIG. 2A, the finishing work machine 10 of the present embodiment is provided with a fan 200 that cools the motor 11 between the motor 11 that rotates the blade 16C and the blade 16C. The fan 200 is not illustrated in FIGS. 1 and 3 for better understanding of the overall configuration of the finishing work machine 10.

In the example illustrated in FIG. 2A, the fan 200 is attached to the rotation shaft 11B of the motor 11 via a fan support arm 210. When the rotation shaft 11B of the motor 11 is rotated by the power supplied from the power supply device 20, the fan 200 supported by the fan support arm 210 is rotated about the Z axis.

Figure 2B:
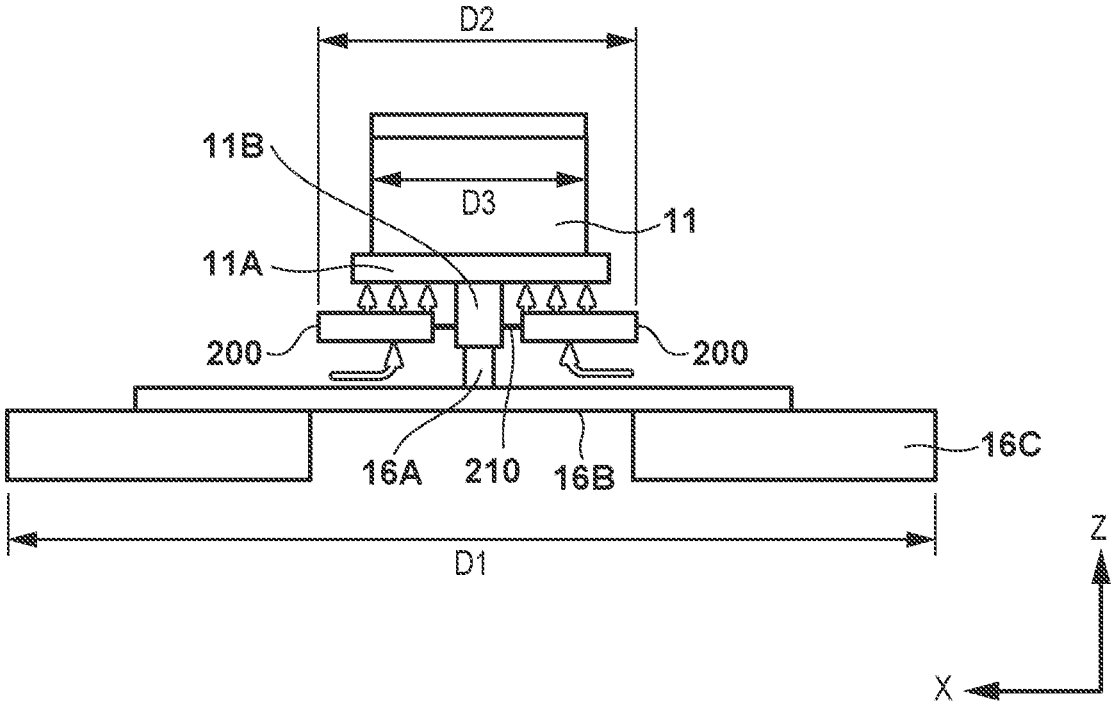
FIG. 2B is a diagram schematically illustrating a flow of air from a fan.
Figure 2C:
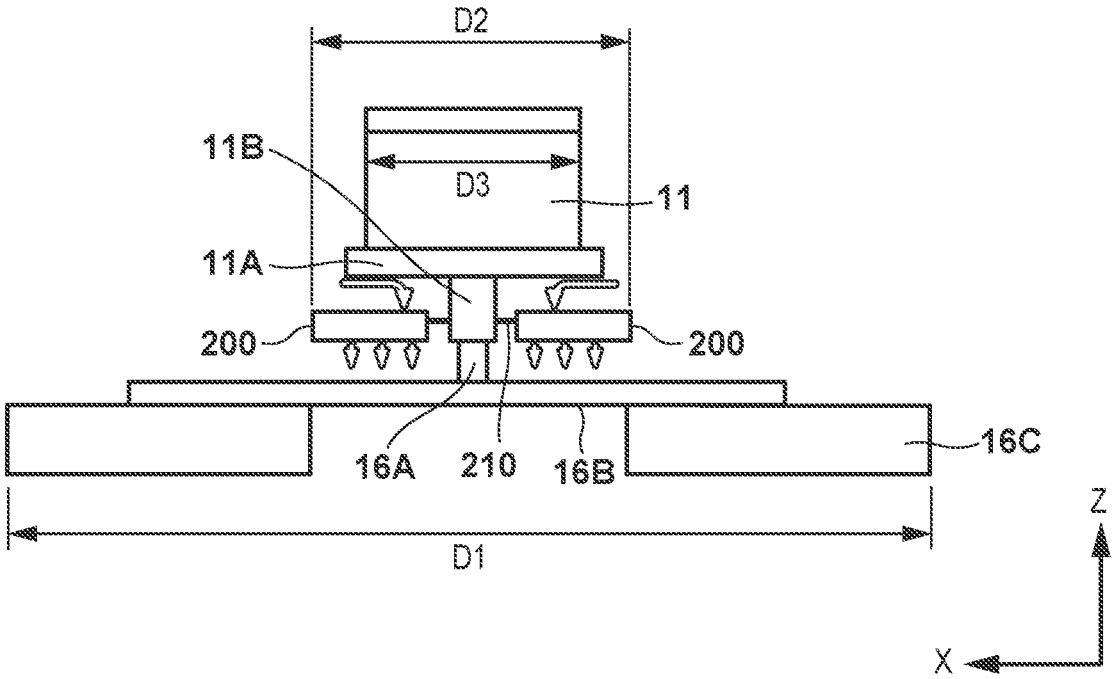
FIG. 2C is a diagram schematically illustrating a flow of air from the fan.

FIGS. 2B and 2C are diagrams schematically illustrating a flow of air from the fan 200. In FIGS. 2B and 2C, arrows schematically indicate the flow of air. FIG. 2B illustrates a state in which the air below the fan 200 flows upward due to the fan 200. The rotation of the fan 200 generates a flow of air from below to above the fan 200. The air flowing upward due to the fan 200 comes into contact with the motor 11, and thus the motor 11 is cooled.

FIG. 2C illustrates a state in which the air above the fan 200 flows downward due to the fan 200. The rotation of the fan 200 generates a flow of air from above to below the fan 200. Air on the upper side of the fan 200 is sucked into the fan 200 to generate a flow in the air on the upper side of the fan 200, and the motor 11 comes into contact with the flowing air such that the motor 11 is cooled. A direction of a flow of the air as illustrated in FIG. 2 or 3 is determined by an attachment angle of the fan 200 with respect to the fan support arm 210.

In FIGS. 2B and 2C, a rotation diameter D1 of the blade 16C indicates a diameter of the circular orbit of the end part of the blade 16C due to the rotation of the blade 16C about the Z axis. A rotation diameter D2 of the fan 200 indicates a diameter of the circular orbit of the end part of the fan 200 due to the rotation of the fan 200 about the Z axis.

As a magnitude relationship between the rotation diameter D1 of the blade 16C and the rotation diameter D2 of the fan 200, for example, the rotation diameter D2 of the fan 200 indicating the diameter of the circular orbit of the end part of the fan 200 is smaller than the rotation diameter D1 of the blade 16C indicating the diameter of the circular orbit of the end part of the blade 16C.

In a case where the rotation diameter D2 of the fan 200 is larger than the rotation diameter D1 of the blade 16C, the overall weight of the frame 12 increases. When the worker grips the handle 18, moves the handle 18 in the front-and-rear direction, and swings the frame 12 of the finishing work machine 10 in the XY plane, if the overall weight of the frame 12 increases, the swinging operation may become difficult. In a case where the rotation diameter D2 of the fan 200 is larger than the rotation diameter D1 of the blade 16C, the rotation of the fan 200 can reduce a region where the worker can visually recognize the inside of the frame 12.

However, as illustrated in FIGS. 2B and 2C, by configuring the rotation diameter D2 of the fan 200 to be smaller than the rotation diameter D1 of the blade 16C, it is possible to improve the visibility of the inside of the frame 12 while suppressing the weight increase of the frame 12, and thus to improve the workability (work efficiency) of the finishing work machine 10.

In FIGS. 2B and 2C, as a magnitude relationship between the rotation diameter D2 of the fan 200 and a diameter D3 of the motor 11, the rotation diameter D2 of the fan 200 indicating the diameter of the circular orbit of the end part of the fan 200 is larger than the diameter D3 of the motor 11. As described above, the entire motor 11 can be efficiently cooled by the air sent from the fan 200 having the rotation diameter D2 larger than the diameter D3 of the motor 11.

Since the rotation of the fan 200 becomes a rotational load on the motor 11, heat generation may increase due to an increase in the rotational load. Therefore, regarding the magnitude relationship between the rotation diameter D2 of the fan 200 and the diameter D3 of the motor 11, for example, the rotation diameter D2 of the fan 200 indicating the diameter of the circular orbit of the end part of the fan 200 may be smaller than the diameter D3 of the motor 11. According to this configuration, cooling by the fan 200 can be performed while reducing a rotational load on the motor 11.

The frame 12 includes a plurality of annular rings 13 (13A, 13B, 13C, 13D) and a plurality of ring support arms 14. In FIG. 2A, the annular rings 13B, 13C, and 13D and the plurality of ring support arms 14 are not illustrated for better understanding of the configuration of the finishing work machine 10. The plurality of annular rings 13 (13A, 13B, 13C, 13D) respectively have different diameters. Among the plurality of annular rings 13, the annular ring 13A disposed on the outermost circumference has the largest diameter, and the annular ring 13D disposed on the innermost circumference has the smallest diameter.

The annular ring 13B has a smaller diameter than that of the annular ring 13A, and is disposed on the inner circumferential side and the upper side with respect to the annular ring 13A. The annular ring 13C has a smaller diameter than that of the annular ring 13B, and is disposed on the inner circumferential side and the upper side with respect to the annular ring 13B. The annular ring 13D has a smaller diameter than that of the annular ring 13C, and is disposed on the inner circumferential side and the upper side with respect to the annular ring 13C.

The plurality of ring support arms 14 support the plurality of annular rings 13 (13A, 13B, 13C, 13D) in the vertical direction (Z direction). The plurality of ring support arms 14 support the annular rings at different positions in the vertical direction. The plurality of ring support arms 14 support the annular ring 13B at a position higher than the annular ring 13A in the vertical direction, support the annular ring 13C at a position higher than the annular ring 13B in the vertical direction, and support the annular ring 13D at a position higher than the annular ring 13C in the vertical direction.

The motor 11 is held by the motor holding member 11A formed at the upper end of the frame 12, and the blade unit 16 is disposed inside the frame 12. The blade unit 16 includes the shaft 16A, the plurality of blade support arms 16B, and the plurality of blades 16C. The shaft 16A extends upward in the Z direction (vertically upward) with respect to the XY plane and is connected to the rotation shaft 11B of the motor 11. The shaft 16A is rotated by receiving torque provided from the rotation shaft 11B of the motor 11. The plurality of blade support arms 16B are provided in a direction (orthogonal direction) intersecting with an axial direction (Z direction) of the shaft 16A, and the blades 16C are respectively attached to the blade support arms 16B.

As illustrated in FIG. 1, the plurality of blade support arms 16B are provided on the shaft 16A at equal intervals. For example, in a case where there are four blade support arms 16B, the blade support arms 16B are provided on the shaft 16A at intervals of 90 degrees. The lower end side of the blade 16C contacts the road surface RS, and the upper end side of the blades 16C is configured to be easily attachable to and detachable from the blade support arm 16B. Consequently, the blade 16C worn due to the contact with the road surface can be easily replaced. A blade angle of the blade 16C may also be adjusted via an attachment member (not illustrated). Here, the blade angle is an angle on an acute angle side between the road surface RS of the concrete and the blade 16C.

The motor 11 is, for example, a servomotor capable of performing rotation control, and functions as a drive source for rotating the blade unit 16 in the finishing work machine 10. The motor 11 includes a stator and a rotor (not illustrated), and generates power (rotational force) for rotating the rotor and the rotation shaft 11B by energizing a coil provided on one of the stator and the rotor. In the present embodiment, the motor 11 is held by the frame 12 via the motor holding member 11A such that the rotation shaft 11B faces downward in the Z direction.

The shaft 16A (rotation shaft) of the blade unit 16 is connected to the rotation shaft 11B of the motor 11. The blade support arm 16B and the blades 16C are rotated due to the rotation of the shaft 16A connected to the rotation shaft 11B of the motor 11. The lower end side of the blade 16C is in contact with the road surface RS, and the unevenness of the road surface RS in the Z direction is leveled due to the rotation of the blades 16C in a state of being in contact with the road surface RS.

The controller 30 is a control device that controls driving of the motor 11, and includes a processor (CPU), a memory, and an interface, and is configured to be able to communicate with the power supply device 20 via the interface. When the worker inputs an operation via a switch (not illustrated), the controller 30 outputs a control signal corresponding to the input operation. For example, the worker can select an operation mode corresponding to the degree of finishing of the road surface RS of the concrete via the switch, and the controller 30 outputs a control signal corresponding to the operation mode selected by the worker to the motor 11 via a communication cable (not illustrated). The control signal is, for example, a rotational speed signal for controlling a rotational speed (rotational speed) of the motor 11, and the controller 30 outputs a control signal for controlling different rotational speeds according to operation modes. The controller 30 outputs a power control signal corresponding to the selected operation mode to a power conversion circuit 20B via a communication cable (not illustrated), and the power conversion circuit 20B controls power to be supplied to the motor 11 on the basis of the power control signal received from the controller 30.

In the finishing work machine 10 of the present embodiment, the power supply device 20 includes a casing 20C, the battery pack 20A, and the power conversion circuit 20B. The power conversion circuit 20B is a so-called inverter circuit, and converts a direct current supplied from the battery pack 20A into an alternating current for the motor 11. The power supply device 20 is electrically connected to the motor 11 via a cable 20F, and supplies an alternating current to the motor 11. The casing 20C of the power supply device 20 is disposed above the motor 11 via a power supply mounting member 20D having a rectangular parallelepiped shape as a schematic shape, for example. The casing 20C may be attached to the motor 11 without the power supply mounting member 20D interposed therebetween.

Figure 4A:
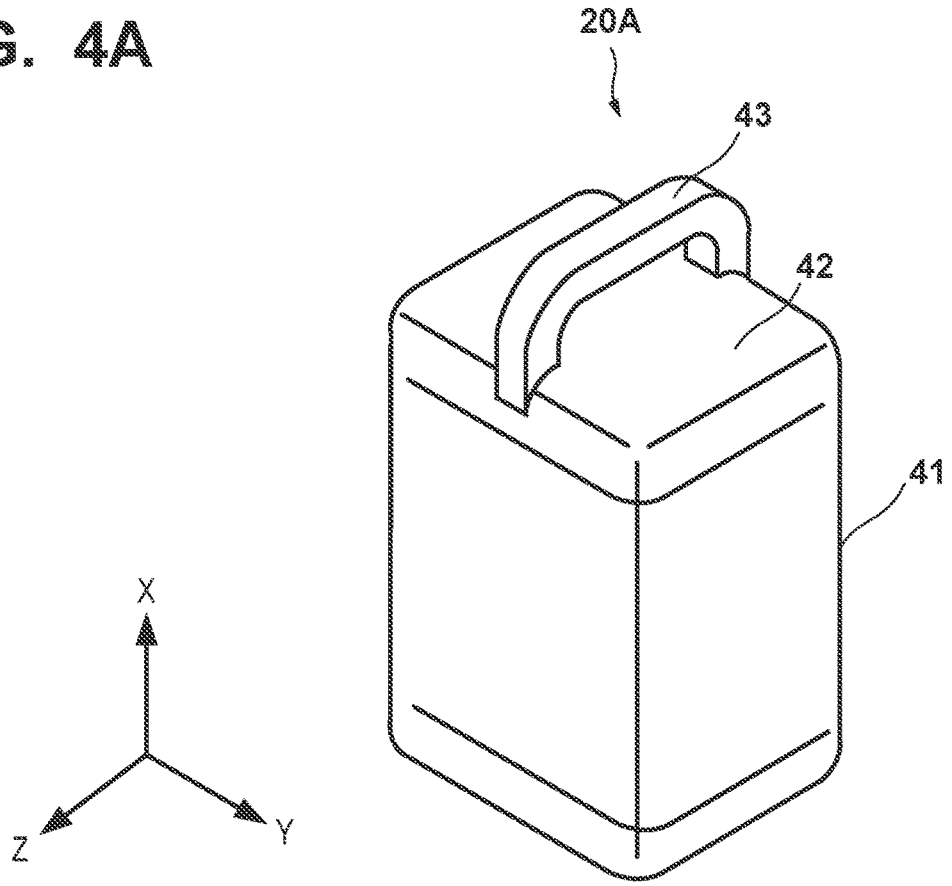
FIG. 4A is a top view of a battery pack.
Figure 4B:
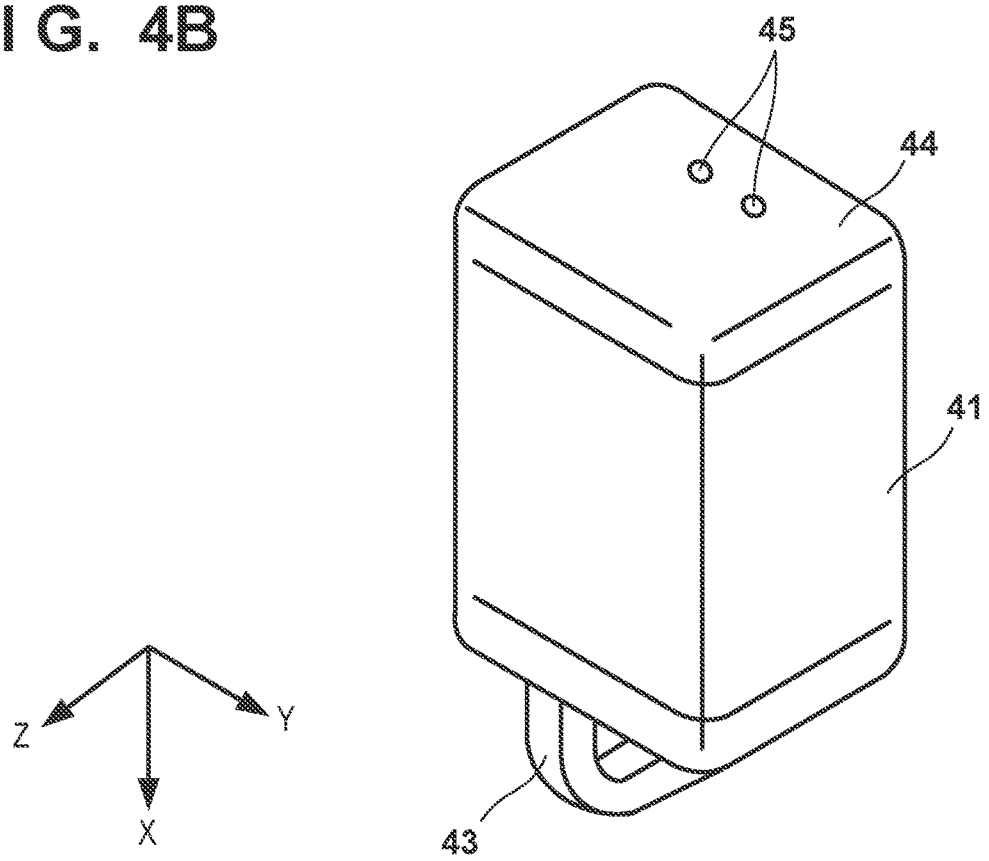
FIG. 4B is a bottom view of the battery pack.

FIGS. 4A and 4B are diagrams illustrating a schematic shape of the battery pack 20A that can be used in the finishing work machine 10 of the present embodiment, FIG. 4A is a diagram of the battery pack 20A viewed from an upper surface side, and FIG. 4B is a diagram of the battery pack 20A viewed from a lower surface side.

The battery pack 20A is a portable battery (mobile power pack: MPP) attachable to and detachable from the power supply device 20 (casing 20C), and as shown in FIGS. 4A and 4B, the battery pack 20A schematically includes a storage battery case 41 configured by a rectangular parallelepiped exterior body, and a battery group (not illustrated) as a power storage unit accommodated in the storage battery case 41. The battery group is preferably a lithium ion secondary battery, but is not particularly limited thereto, and for example, an all-solid-state battery or a secondary battery such as a nickel-metal hydride battery or a nickel-cadmium battery may be used.

In the finishing work machine 10 of the present embodiment, by using the detachable portable battery (MPP) as the configuration of the battery pack 20A, the finishing work can be continuously performed without waiting for the charging time by replacing a discharged portable battery (MPP) with a charged portable battery (MPP) without performing charging by connecting a power cable to the finishing work machine 10.

A handle 43 is provided on an upper surface 42 of the storage battery case 41. The handle 43 is gripped when the worker carries the battery pack 20A.

An opening 20E through which the battery pack 20A can be mounted to the casing 20C of the power supply device 20 and the battery pack 20A can be taken out from the casing 20C is formed on the casing surface of the power supply device 20 at a position close to the operation member 17 and the handle 18.

As illustrated in FIG. 1, an opening 20E is formed on a surface of the casing 20C of the power supply device 20 formed at a position close to the operation member 17 and the handle 18, and the worker can accommodate the battery pack 20A in the casing 20C through the opening 20E while gripping the handle 43. On the lower surface 44 of the battery pack 20A, an opening 45 into which an electrode probe of the power conversion circuit 20B can be inserted is formed. Inside the storage battery case 41, an electrode (not illustrated) connected to the battery group is provided. When the battery pack 20A is accommodated in the casing 20C and the battery pack 20A is inserted to the position of the power conversion circuit 20B, the electrode probe of the power conversion circuit 20B and the electrode of the battery group are connected to establish electrical connection. When replacing the battery pack 20A, the worker grips the handle 43 and pulls out the battery pack 20A to the opening 20E side, and thus the electrical connection between the electrode probe and the electrode is canceled and the battery pack 20A can be taken out from the casing 20C.

(Modification Example of Disposition of Fan 200)

In FIGS. 2A to 2C, a configuration example in which the fan 200 is attached to the rotation shaft 11B of the motor 11 via the fan support arm 210 has been described, but the present invention is not limited to this example. For example, even when the fan 200 is attached to the shaft 16A of the blade unit 16 via the fan support arm 210, a similar effect can be achieved.

The fan 200 may be attached to the blade 16C without using the fan support arm 210. For example, as illustrated in FIG. 5, the fan 200 may be attached to the blade 16C, and the fan 200 may be rotated with the rotation of the blade 16C.

The fan 200 may be attached to the blade support arm 16B that supports the blade 16C without using the fan support arm 210. For example, as illustrated in FIG. 6, the fan 200 may be attached to a blade support arm 16B that supports the blade 16C, and the fan 200 may be rotated with the rotation of the blade support arm 16B.

Figure 5:
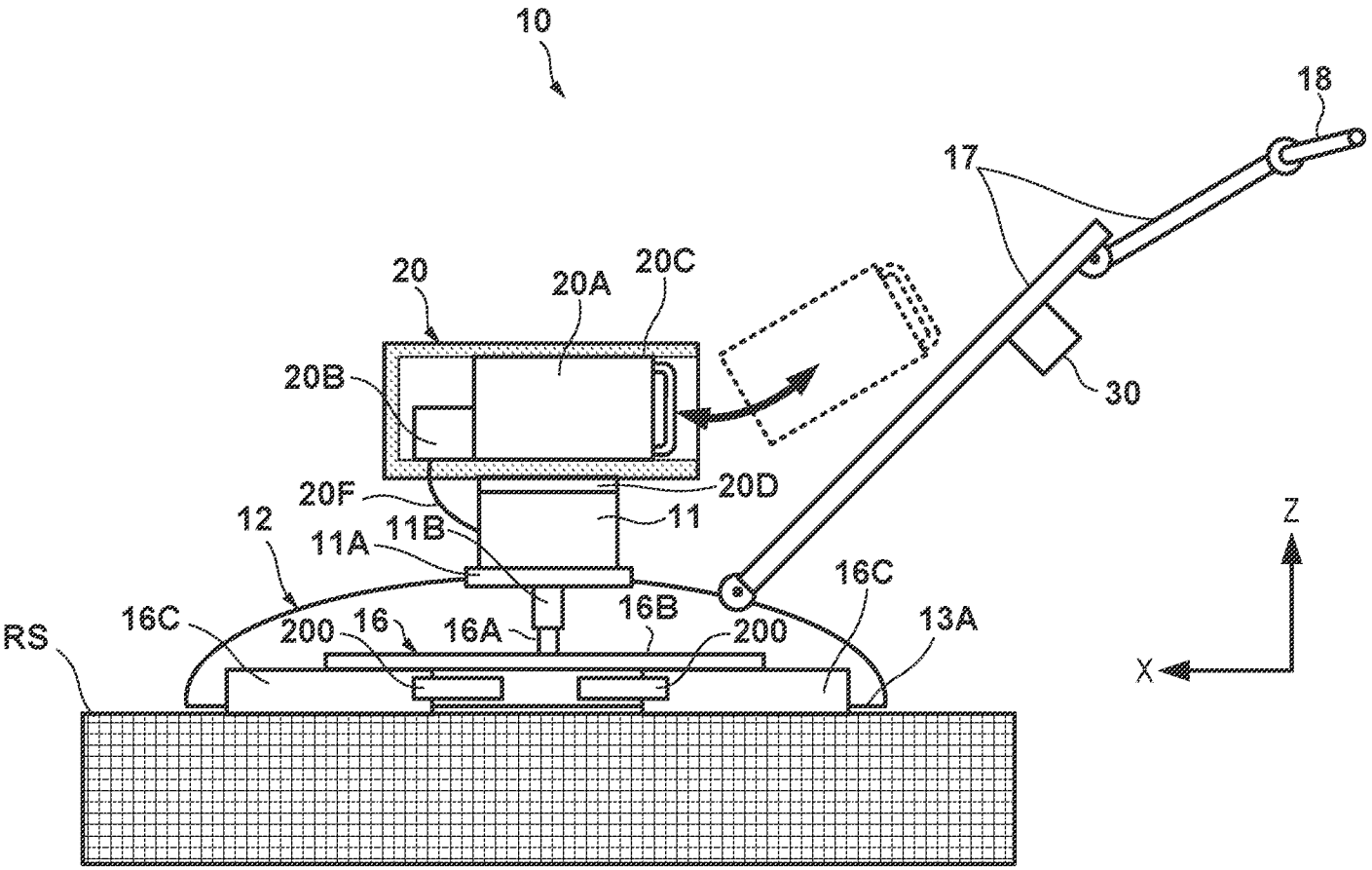
FIG. 5 is a diagram illustrating a modification example of the disposition of the fan.
Figure 6:
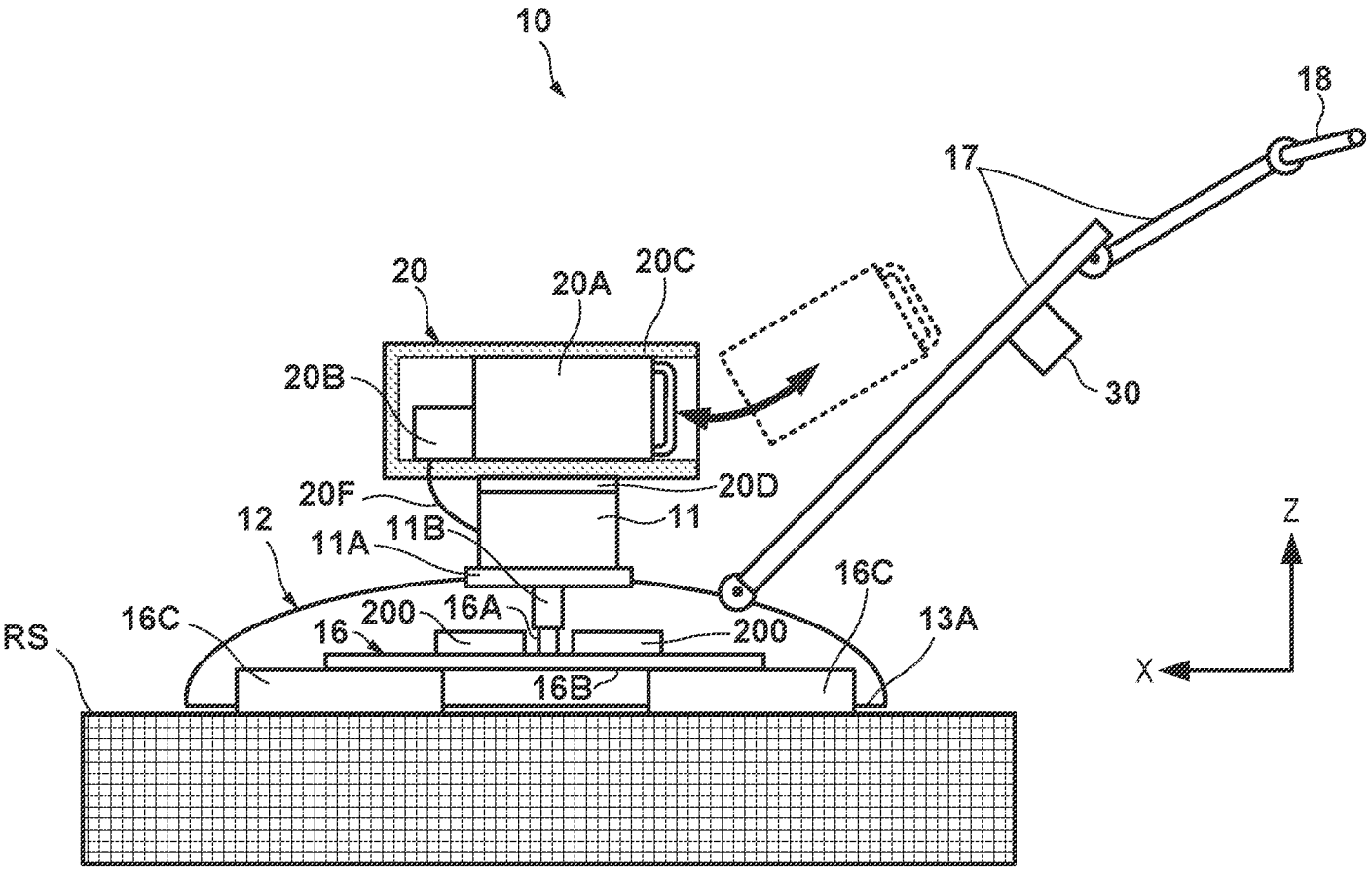
FIG. 6 is a diagram illustrating a modification example of the disposition of the fan.

According to the configuration of the modification example in FIG. 5 or 6, the cost can be reduced by reducing the number of components by not using the fan support arm 210. The rotational load on the motor 11 can be reduced by the weight of the fan support arm 210, and heat generation of the motor 11 due to the reduction in the rotational load can be suppressed.

Summary of Embodiments

1. The work machine of the above embodiment is the work machine 10 that smooths the road surface RS by rotating the blade 16C contacting the road surface RS, and includes:

the motor 11 that rotates the blade 16C; and the fan 200 that cools the motor 11 and is provided between the motor 11 and the blade 16C.

According to Configuration 1, the work machine having excellent cooling performance can be provided. Consequently, it is possible to stabilize the battery output and to prolong the life of the battery.

2. In the above embodiment, the rotation diameter D2 of the fan 200 indicating the diameter of the circular orbit of the end part of the fan 200 is smaller than the rotation diameter D1 of the blade 16C indicating the diameter of the circular orbit of the end part of the blade 16C.

According to Configuration 2, the visibility of the inside of the frame 12 can be improved while suppressing the weight increase of the frame 12, and thus the workability (work efficiency) of the finishing work machine 10 can be improved.

3. In the above embodiment, the rotation diameter D2 of the fan 200 indicating the diameter of the circular orbit of the end part of the fan 200 is larger than the diameter D3 of the motor 11.

According to Configuration 3, the entire motor 11 can be efficiently cooled by air sent from the fan 200 having the rotation diameter D2 larger than the diameter D3 of the motor 11.

4. In the above embodiment, the rotation diameter D2 of the fan 200 indicating the diameter of the circular orbit of the end part of the fan 200 is smaller than the diameter D3 of the motor 11.

According to Configuration 4, it is possible to perform cooling using the fan 200 while reducing the rotational load on the motor 11.

5. In the above embodiment, the fan 200 is attached to the blade 16C, and the fan 200 is rotated with the rotation of the blade 16C.

6. In the above embodiment, the fan 200 is attached to the blade support arm 16B that supports the blade 16C, and the fan 200 is rotated with the rotation of the blade support arm 16B.

According to Configurations 5 and 6, since the fan support arm 210 is not used, the cost can be reduced by reducing the number of components. The rotational load on the motor 11 can be reduced by the weight of the fan support arm 210, and heat generation of the motor 11 due to the reduction in the rotational load can be suppressed.

The invention is not limited to the foregoing embodiments, and various variations/changes are possible within the spirit of the invention.

What is claimed is:

1. A work machine that smooths a road surface by rotating a blade contacting the road surface, the work machine comprising:

a motor that rotates the blade;

a power supply device having a battery pack that supplies electric power to the motor; and a fan that cools the motor and is provided between the motor and the blade, wherein a casing of the power supply device is disposed above the motor, the battery pack is a portable battery attachable to the casing and detachable from the casing of the power supply device, the fan is positioned coaxially with the motor shaft, is configured to rotate integrally with the motor shaft, and is located between the motor and the blade such that cooling air is directed toward the motor, the casing of the power supply device is configured to be mounted directly above the motor in a vertically stacked arrangement, and the battery pack is configured to be removably attached to the casing, allowing for easy replacement without disassembling the motor and the casing.

2. The work machine according to claim 1, wherein a rotation diameter of the fan indicating a diameter of a circular orbit of an end part of the fan is smaller than a rotation diameter of the blade indicating a diameter of a circular orbit of an end part of the blade.

3. The work machine according to claim 1, wherein a rotation diameter of the fan indicating a diameter of a circular orbit of an end part of the fan is larger than a diameter of the motor.

4. The work machine according to claim 1, wherein a rotation diameter of the fan indicating a diameter of a circular orbit of an end part of the fan is smaller than a diameter of the motor.

5. The work machine according to claim 1, wherein the fan is attached to the blade, and the fan is rotated with rotation of the blade.

6. The work machine according to claim 1, wherein the fan is attached to a blade supporting arm that supports the blade, and the fan is rotated with rotation of the blade support arm.

* * * * *